US008481469B2

(12) United States Patent
Cook et al.

(10) Patent No.: US 8,481,469 B2
(45) **Date of Patent: *Jul. 9, 2013**

(54) RUST INHIBITORS TO MINIMIZE TURBO SLUDGE

(75) Inventors: Stephen J. Cook, Belper (GB); Jolanta Z. Adamczewska, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 83 days.

This patent is subject to a terminal disclaimer.

(21) Appl. No.: 12/990,788

(22) PCT Filed: May 6, 2009

(86) PCT No.: PCT/US2009/042936

§ 371 (c)(1),
(2), (4) Date: Jan. 24, 2011

(87) PCT Pub. No.: WO2009/140108

PCT Pub. Date: Nov. 19, 2009

(65) Prior Publication Data

US 2011/0118157 A1 May 19, 2011

Related U.S. Application Data

(60) Provisional application No. 61/052,750, filed on May 13, 2008.

(51) Int. Cl.
*C10M 145/24* (2006.01)

(52) U.S. Cl.
USPC ..... 508/579; 508/110; 508/501; 508/539

(58) Field of Classification Search
USPC ..... 508/579
See application file for complete search history.

(56) References Cited

U.S. PATENT DOCUMENTS

| | | | | |
|---|---|---|---|---|
| 4,493,776 | A | 1/1985 | Rhodes | |
| 5,202,036 | A * | 4/1993 | Ripple et al. | 508/192 |
| 5,422,022 | A * | 6/1995 | Chamberlin, III | 508/390 |
| 5,958,848 | A * | 9/1999 | Robson | 508/232 |
| 6,235,687 | B1 * | 5/2001 | Nadasdi et al. | 508/304 |
| 6,340,659 | B1 * | 1/2002 | Kocsis et al. | 508/518 |
| 6,405,721 | B1 * | 6/2002 | Moren | 123/572 |
| 6,458,750 | B1 * | 10/2002 | Dardin et al. | 508/501 |
| 6,586,376 | B1 | 7/2003 | Nakanishi et al. | |
| 6,642,188 | B1 * | 11/2003 | Hartley et al. | 508/291 |
| 6,770,605 | B1 | 8/2004 | Stachew et al. | |
| 6,793,468 | B2 * | 9/2004 | Ojima et al. | 417/407 |
| 6,916,766 | B2 * | 7/2005 | Buzdygon et al. | 508/192 |
| 7,043,402 | B2 * | 5/2006 | Phillips et al. | 702/184 |
| 7,144,436 | B2 * | 12/2006 | Barbour et al. | 44/436 |
| 7,716,972 | B2 * | 5/2010 | Preston | 73/114.55 |
| 7,807,611 | B2 * | 10/2010 | Kocsis et al. | 508/506 |
| 7,825,076 | B2 * | 11/2010 | Hall | 508/371 |
| 8,179,242 | B2 * | 5/2012 | Schneider | 340/438 |
| 2003/0162674 | A1 | 8/2003 | Scott | |
| 2007/0187293 | A1 * | 8/2007 | Cherrillo et al. | 208/15 |

FOREIGN PATENT DOCUMENTS

| | | |
|---|---|---|
| EP | 0779355 | 6/1997 |
| EP | 0602198 | 8/1999 |
| WO | 0052117 | 9/2000 |

OTHER PUBLICATIONS

Holborn Europa Raffinerie GmbH: "Spezifikation Regular Benzin/Diesel DIN EN 228/EN 590"; Apr. 1, 2002.

* cited by examiner

*Primary Examiner* — Ellen McAvoy
(74) *Attorney, Agent, or Firm* — David M. Shold; Michael F. Esposito

(57) ABSTRACT

A turbo-charged, sump-lubricated internal combustion engine which is susceptible to contamination of lubricant with liquid fuel, may be lubricated with a lubricant which contains an amount of a rust inhibitor effective to reduce the deterioration of said lubricant and turbo sludge formation.

8 Claims, No Drawings

RUST INHIBITORS TO MINIMIZE TURBO SLUDGE

BACKGROUND OF THE INVENTION

The disclosed technology relates to reduction of turbo sludge formation in the course of lubricating a turbo-charged, sump-lubricated internal combustion engine which is susceptible to contamination of lubricant with liquid fuel.

Modern engine lubricants are formulated to provide performance in a number of important areas. One of these areas is the minimization of sludge and related deposits in the engine. Problems with excessive sludge formation have historically been associated with extensive stop-and-go driving particularly during cold, damp weather conditions. Sludge formation in the crankcase and oils passages of an engine can seriously limit the ability of the crankcase oil to lubricate the engine effectively. To address this problem, most engine lubricants contain dispersants such as succinimide dispersants of various types, and these have usually been quite effective at retaining sludge-forming materials in solution or dispersion. An example of the use of a succinimide dispersant to address problems of sludge is reported in U.S. Pat. No. 6,770,605, Stachew et al., Aug. 3, 2004.

Recently, however, new sludge problems have appeared. Sludge and deposits have been observed, especially in turbochargedengines, and in particular turbo-charged gasoline (spark-ignited) engines, for instance, on the cylinder head and in the lubricant sump. This heavy sludge and deposit formation may lead to bearing oil starvation and blockage of the oil feed filter and, in extreme cases, to catastrophic engine failure. These problems seem more severe in engines that are fueled with certain grades of gasoline. This "turbo sludge" problem has been resistant to solution by the customary use of dispersants.

Lubricants for internal combustion engines, including those equipped with turbochargers, are known. For example, U.S. Pat. No. 6,458,750, Dardin et al., Oct. 1, 2002, discloses an engine oil composition with reduced deposit-formation tendency, including an alkyl alkoxylate. Deposit formation is evaluated in terms of, among other things, turbo deposition in heavy diesel engines. U.S. Pat. No. 6,586,276, Nakanishi et al., Jul. 1, 2003, discloses a heat resistant and oxidation resistant lubricating oil composition which includes a polyphenylthioether as an antioxidant or a lubricating base oil component. A heat resistant base oil may be used. The lubricant is suitable for automobile engines such as turbo engines, and jet engines and gas turbines operated at high speed and high temperature. U.S. Patent Application Publication US 2003/0162674, Scott, Aug. 28, 2003, discloses a heavy duty diesel engine lubricating oil comprising a Group III basestock, a detergent composition, and one or more other additives. The lubricant is said to minimize the loss of efficiency of a turbocharger included in the engine assembly.

It is believed that the prior art does not recognize the unique difficulties associated with turbo sludge nor does it provide a way to minimize the turbo sludge.

SUMMARY OF THE INVENTION

The disclosed technology provides a method for lubricating a turbo-charged, sump-lubricated internal combustion engine which is susceptible to contamination of lubricant with liquid fuel (and in some embodiments in which the lubricant is in fact contaminated with fuel), comprising providing said engine with a lubricant which contains an amount of a rust inhibitor effective to reduce the deterioration of said lubricant.

DETAILED DESCRIPTION OF THE INVENTION

Various features and embodiments will be described below by way of non-limiting illustration.

The present inventors have analyzed turbo sludge and determined that chemically it is not obviously different from ordinary engine sludge. Both are substantially carbonaceous or hydrocarbonaceous materials which may contain organic acids. However, turbo sludge appears to be more brittle than ordinary sludge and may consist of discrete particles of sediment of millimeter and sub-millimeter size (e.g, 0.1 to 1 mm).

The turbo sludge formation appears to be more prominent or more often formed when certain gasoline grades are used as fuels. Gasolines in general are hydrocarbon distillate fuels in the gasoline range, such as those meeting the specifications given in American Society for Testing and Materials Specification D-439, "Standard Specification for Automotive Gasoline." Gasolines may generally have a boiling range of 30 to 215° C. or, more precisely, as defined by ASTM specification D86-00 for a mixture of hydrocarbons having a distillation range from about 60° C. at the 10% distillation point to about 205° C. at the 90% distillation point. Gasoline is typically composed of a mixture of various types of hydrocarbons including aromatics, olefins, paraffins, isoparaffins, naphthenes and occasionally diolefins. Liquid fuel compositions comprising non-hydrocarbonaceous materials such as alcohols, ethers, and organo-nitro compounds (e.g., methanol, ethanol, diethyl ether, methyl ethyl ether, methyl t-butyl ether, nitromethane) may also benefit from the present invention. The gasoline may have a sulphur content of less than or equal to 50 parts per million by weight or alternatively less than 30 or 20 or 15 or 10 parts per million, and a lower level of 0 or 0.1 or 0.5 or 1 or 2 parts per million. The gasoline may have any of the conventional octane ratings and may contain the conventional additives used for treatment of gasoline, e.g., solvents, anti-knock compounds, detergents, dispersants, fluidizers, and scavengers. Gasolines may also include materials prepared by a Fischer-Tropsch gas to liquid process and emulsified water-blended fuel compositions as described, for instance, in U.S. Pat. No. 6,858,046, Daly et al., Feb. 2, 2005.

The present inventors have determined that the problem of turbo sludge tends to be more severe when fuels are used which contain a relatively higher percentage of high boiling material and which contain a relatively large fraction of cyclic materials such as aromatics, in particular, relatively high boiling (>150° C.) cyclic materials such as aromatics. In some such severe fuels, there may also be a relatively high percentage of naphthenic fraction (also called cycloparaffins). It will be recognized, however, that there may be other parameters as well in determining the sludge-forming tendency of a fuel. Focusing on the boiling range, for instance, a "clean" fuel (one which produces little or no turbo sludge) may have a boiling range such that 10 percent or even less of the fuel boils above 150° C. at atmospheric pressure. On the other hand, in a "dirty" fuel, 30 percent or more (or greater than 10 percent, 15 percent, 20 percent, or percent) may boil above 150° C. The high boiling fraction appears to comprise aromatic or naphthenic components, including aromatic materials having one or more hydrocarbyl substituents totaling 3 or more carbon atoms, or alternatively polycyclic paraffins such as "decalin" (decahydronapthalene) and other closely related dicyclic species. An appreciable fraction (e.g., 4-15%, 5-12%, or 6-10%) of such fuels may boil in the range of 180 to 200° C. or 184 to 196° C. Thus a "clean" fuel may contain 5 percent or less of aromatics (e.g., 3% or less or 1% or less, such as down to 0.1 or 0.5%) and a "dirty" fuel may contain larger amounts of aromatics, e.g., greater than 5 percent, 10 percent, 12 percent, or 14 percent. An upper amount of aromatic component or naphthenes in such a fuel is not rigidly defined but may be, in certain embodiments, up to 30 percent or 20 percent by weight. These values, of course, may not always be definitive if other factors may be important for a given fuel, such as sulfur content, aromatic content, olefins content, ratio of monocyclic to dicyclic naphthenes, or isoparaffin content.

While not wishing to be bound by any theory, the inventors speculate that cyclic (or other deleterious) materials as described above may find their way into the lubricant system as a contaminant and may be retained there for comparatively longer times because of their higher boiling temperatures, compared to other portions of the fuel contaminant. These materials and the lubricant in which they are contained, will be, during the course of lubrication, be exposed to the high temperatures of a turbocharger, which are typically higher than temperature encountered during lubrication of a conventional engine, e.g., at least 180° C. or at least 200° C. or at least 250° C. or even at least 300° C. Under these conditions, the lubricant mixture may deteriorate, leading to the formation of the turbo sludge. Whether the naphthenic component of the gasoline itself (or its decomposition product) becomes a major component of the turbo sludge, or whether the naphthenic component catalyzes formation of turbo sludge from components of the lubricant itself, or some combination thereof, is not known with certainty. However, it is proposed that the turbo sludge or precursors thereof may be formed initially within the turbocharger but then be washed away by additional lubricant and thereby accumulate in other parts of the engine such as the sump.

The problem of turbo sludge is reduced or eliminated by use of a lubricant that comprises an oil of lubricating viscosity, an effective amount of a rust inhibitor, and, typically, other additives. Thus, the present technology includes the use of a rust inhibitor in such a lubricant to reduce or eliminate turbo sludge.

The oil of lubricating viscosity, or base oil, used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used. In certain embodiments of the present invention, the oil used to form the final lubricant composition (including contributions from oil used as diluent oil for additives) may contain at most 60 percent by weight Group I oil, or at most 40 or 20 or 10%. In such cases, a complementary amount of the oil may be group II, III, IV, or V.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used. Synthetic oils may be used such as those produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed herein-above can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of the base oil in the lubricant composition will typically be the amount of the composition remaining after the other named components and additives are accounted for. The amounts reported herein, unless otherwise indicated, are amounts exclusive of any amount of contamination that may be present in the lubricant, derived from the fuel or components of the fuel. In general, the amount of oil of lubricating viscosity 50 to 99 percent by weight, more commonly 80 to 97 percent by weight or 85 to 95 or 88 to 93 percent by weight. The amount of diluent oil that may be included within any additive components is to be considered as added to and a part of the base oil. Alternatively, the composition of the present invention may itself be provided as a concentrate intended to be mixed with further base oil in order to prepare the final lubricant composition. In such a case the amount of base oil may be 20 to 80 percent or 21 to 75 or 22 to 70 or 23 to 60 or 24 to 50 or 25 to 40 or 30 to 40 percent by weight.

The lubricant useful in the present invention will contain a rust inhibitor in an amount effective to reduce deterioration of the lubricant, and in particular, in an amount effective to reduce the formation of turbo sludge. It is believed that heretofore it has not been recognized that rust inhibitors will have any effect on sludge or turbo sludge formation in an engine lubricant. While not wishing to be bound by any theory, the present inventors speculate that the presence of iron, solubilized or dispersed in the lubricant, may catalyze the oxidative degradation of components of the lubricating oil or, in particular, the above-described components of gasoline contaminants. It is speculated that this degradation, in combination with the elevated temperatures encountered by the lubricant in a turbo-charged engine, may contribute to the formation of turbo sludge.

The term "rust inhibitor" is intended to encompass materials which may function by any of a variety of means to reduce iron contamination of a lubricant. They may function, for instance by modification of oil/water demulsibility properties, direct chemical inhibition of rust, or metal passivation. Rust inhibitors may function either in vapor phase or liquid phase. Rust inhibitors comprise a diverse group of chemicals which are known to reduce rust formation, that is, oxidation of iron and ferrous alloys, when they are included in a fluid in contact with the iron. Rust inhibitors are a subset of the broader class of corrosion inhibitors, which include materials that are effective to reduce corrosion of other metals such as brass and other "yellow metals." In order to be effective as engine lubricant additives, the rust inhibitors should be oil soluble or oil dispersible and should have sufficiently low volatility or a sufficiently high boiling point or flash point to be practically used in the environment of an internal combustion engine. For instance, a boiling point of at least 150° C. or 200° C. or 250° C. at atmospheric pressure may be desirable.

Rust inhibitors include organic compound having one or more of an amine group, an ether group, a hydroxyl group, a carboxylic acid, ester, or salt group, or a nitrogen-containing heterocyclic group. Examples thus include fatty amines such as oleylamine, hydroxyamines such as isopropanolamine; condensates of hydroxyamines with fatty acids (such as the product of tall oil fatty acid with diethanolamine or with N-hydroxyethylethylenediamine), carboxylic acids, esters, and salts (such as alkyl substituted succinic acids, esters, and amine or ammonium salts, e.g., the mono- or di-ester from a succinic acid and propylene oxide), and compounds with multiple functionalities. Examples of the latter include sarcosine derivatives, having amide and acid functionality (e.g., $R^1CO—NR^2—CH_2—COOH$). Materials with nitrogen-containing heterocyles include triazole compounds such as tolyltriazole and triazine salts. Other rust inhibitors include ethoxylated phenols. Other rust inhibitors include various oxygenated materials that may be formed by partial oxidation of waxes or oils. Examples include paraffinic oil oxidates, wax oxidates, and petroleum oxidates. Other rust inhibitors include organic boron compounds such as long chain alkenyl amide borates. Yet others include alkali metal sulfonates such as sodium sulfonates and sodium alkylbenzenesulfonates.

Other rust inhibitors include esters of hydroxy-acids such as tartaric acid, citric acid, malic acid, lactic acid, oxalic acid, glycolic acid, hydroxypropionic acid, and hydroxyglutaric acid. Examples of these include esters, including tartrate esters (that is, especially the diesters), formed from C6-12 or C6-10 or C8-10 alcohols, e.g., isotridecyl tartrate, 2-ethylhexyl tartrate, and mixed tartrate esters of C12-14 linear alcohol/C13 branched alcohol (e.g., 80-95:20-5 ratios or 90:10 ratio). Amides and imides of such materials may also be useful. Such materials include those more fully described in copending application U.S. 61/037,843 filed Mar. 19, 2008.

Yet other rust inhibitors include polyethers. These include polyalkylene oxides such as polyethylene oxide, polypropylene oxide, and copolymers of ethylene oxide and propylene oxide. Such polyethers may be capped at one end with an alkyl group such as a butyl group. Materials of this type are commercially available and are believed to be butyl-capped polypropylene oxides or butyl-capped ethylene oxide-propylene oxide copolymers. Such materials, if they contain a hydroxy group at one end of the chain, may also be referred to as polyether alcohols or polyether polyols.

In one embodiment the rust inhibitor is a polyether. In other embodiments the rust inhibitor is one or more of a fatty amine, a condensate of a hydroxyamine with a fatty acid, a carboxylic acid, ester, or salt, a sarcosine derivative, a triazole compound, an ethyoxylated phenol, a partially oxidized wax or oil, a long chain alkenyl amide borate, an ester of a hydroxy acid, or a sodium sulfonate.

The effective amount of the rust inhibitor in the lubricant formulation will typically be 0.02 to 2 percent by weight of the lubricant and in alternative embodiments 0.05 to 1% or 0.1 to 0.5% or 0.1 to 0.2%.

Other additives that may be used in the lubricants of the present invention include one or more metal-containing detergents. Metal-containing detergents are typically overbased materials, or overbased detergents. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, e.g., carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN). TBN is the amount of strong acid needed to neutralize all of the overbased material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present invention typically have a TBN (oil-free basis) of 100 to 800, and in one embodiment 150 to 750, and in another, 200 or 400 to 700. If multiple detergents are employed, the overall TBN of the detergent component (that is, an average of all the specific detergents together) will typically be in the above ranges.

The overall TBN of the composition, including oil, will derived from the TBN contribution of the individual components, such as the dispersant, the detergent, and other basic materials. The overall TBN will typically be at least 5 or at least 7 or at least 10, or sometimes even at least 20. Sulfated ash (ASTM D-874) is another parameter often used to characterize such compositions. Certain of the compositions of the present invention can have sulfated ash levels of 0.5 to 5% or 0.8 to 4% or to 2%, for instance, greater than 0.8%, greater than 1.0%, or even greater than 2%.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment the Group 2 metals are magnesium, calcium, barium, or zinc, and in another embodiments magnesium or calcium. In certain embodiments the metal is calcium or sodium or a mixture of calcium and sodium. Generally the metal compounds are delivered as metal salts or bases. The anionic portion of the compound can be hydroxide, oxide, carbonate, borate, or nitrate.

Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricants of the present invention can contain an overbased sulfonate detergent. Suitable sulfonic acids for the sulfonate detergent include sulfonic and thiosulfonic acids. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$—$(SO_3—)_b$, where T is a cyclic nucleus such as typically benzene; $R_2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ in the above formulas can also contain other inorganic or organic substituents In the above formulas, a and b are at least 1. In one embodiment, an alkali metal (e.g. sodium) salt such as an overbased sodium arene-sulfonate detergent is present in an amount to provide 0.004 to 0.4 percent by weight of the alkali metal to the lubricant.

Another overbased material which can be present is an overbased phenate detergent. The phenols useful in making phenate detergents can be represented by the formula $(R^1)_a$—Ar—$(OH)_b$, wherein $R^1$ is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there is an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. A general example of such a saligenin derivative can be represented by the formula

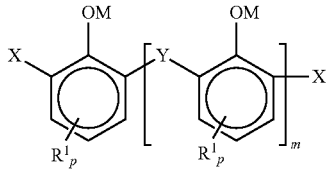

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion, $R_1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion (that is, ½ mole of $Mg^{2+}$) or a mixture of Mg and hydrogen. Other metals include alkali metals such as lithium, sodium, or potassium; alkaline earth metals such as calcium or barium; and other metals such as copper, zinc, and tin. As used in this document, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations. Saligenin detergents are disclosed in greater detail in U.S. Pat. No. 6,310,009, with special reference to their methods of synthesis (Column 8 and Example 1) and particular amounts of the various species of X and Y (Column 6).

Salixarate detergents are overbased materials that can be represented by a substantially linear compound comprising at least one unit of formula (I) or formula (II):

(I)

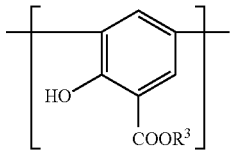

(II)

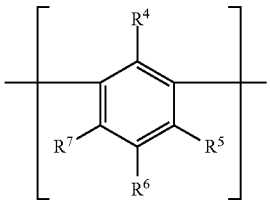

each end of the compound having a terminal group of formula (III) or (IV):

(III)

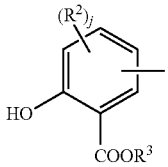

(IV)

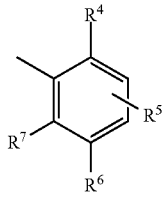

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

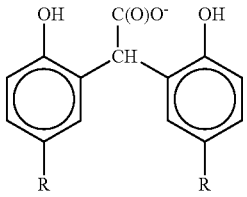

wherein each R is independently an alkyl group containing at least 4 or at least 8 carbon atoms, provided that the total number of carbon atoms in all such R groups is at least 12 or at least 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid and other omega-oxoalkanoic acids. Overbased glyoxylic detergents and their methods of preparation are disclosed in greater detail in U.S. Pat. No. 6,310,011 and references cited therein.

The overbased detergent can also be an overbased salicylate, which may be an alkali metal salt or an alkaline earth metal salt of an alkylsalicylic acid. The salicylic acids may be hydrocarbyl-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to 16, or 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Alkyl salicylates may be prepared from an alkylphenol by Kolbe-Schmitt reaction; alternatively, calcium salicylate can be produced by direct neutralization of alkylphenol and subsequent carbonation. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

The amount of the overbased detergent, in the formulations of the present invention, is typically at least 0.6 weight percent on an oil-free basis. In other embodiments, it can be present in amounts of 0.7 to 5 weight percent or 1 to 3 weight percent. Either a single detergent or multiple detergents can be present.

Another lubricant additive is a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

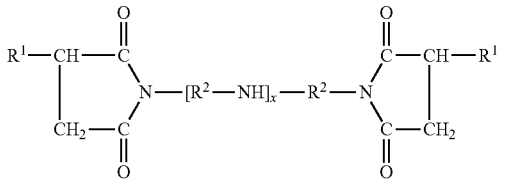

where each $R^1$ is independently an alkyl group, frequently a polyisobutylene group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

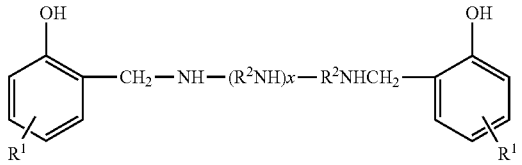

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The lubricant composition will typically also include a metal salt of a phosphorus acid. Metal salts of the formula

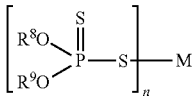

wherein $R^8$ and $R^9$ are independently hydrocarbyl groups containing 3 to 30 or to 20, to 16, or to 14 carbon atoms are readily obtainable by the reaction of phosphorus pentasulfide ($P_2S_5$ or $P_4S_{10}$) and an alcohol or phenol to form an O,O-dihydrocarbyl phosphorodithioic acid corresponding to the formula

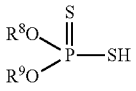

The reaction involves mixing, at a temperature of 20° C. to 200° C., at least four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum, lead, tin, manganese, cobalt, nickel, zinc, or copper, and in some embodiments, zinc. The basic metal compound may thus be zinc oxide, and the resulting metal compound is represented by the formula

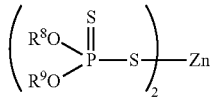

The $R^8$ and $R^9$ groups are independently hydrocarbyl groups that may be free from acetylenic and usually also from ethylenic unsaturation. They are typically alkyl, cycloalkyl, aralkyl or alkaryl group and have 3 to 20 carbon atoms, 3 to 16 carbon atoms, or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and isopropanol or, alternatively, a mixture of secondary alcohols such as isopropanol and 4-methyl-2-pentanol. Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.1 to 4 percent by weight, such as 0.5 to 2 percent by weight, or 0.75 to 1.25 percent by weight. Its concentration in a concentrate will be correspondingly increased, to, e.g., 5 to 20 weight percent.

The oil of lubricating viscosity will generally be selected so as to provide, among other properties, an appropriate viscosity and viscosity index. Most modern engine lubricants are multigrade lubricant which contain viscosity index improvers to provide suitable viscosity at both low and high temperatures. While the viscosity modifier is sometimes considered a part of the base oil, it is more properly considered as a separate component, the selection of which is within the abilities of the person skilled in the art.

Viscosity modifiers generally are polymeric materials characterized as being hydrocarbon-based polymers generally having number average molecular weights between 25,000 and 500,000, e.g., between 50,000 and 200,000.

Hydrocarbon polymers can be used as viscosity index improvers. Examples include homopolymers and copolymers of two or more monomers of C2 to C30, e.g., C2 to C8 olefins, including both alphaolefins and internal olefins, which may be straight or branched, aliphatic, aromatic, alkyl-aromatic, or cycloaliphatic. Examples include ethylene-propylene copolymers, generally referred to as OCP's, prepared by copolymerizing ethylene and propylene by known processes.

Hydrogenated styrene-conjugated diene copolymers are another class of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene. Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of C4-18 alcohols also are useful as viscosity modifying additives in motor oils. Likewise, polymethacrylates (PMA) are used as viscosity modifiers. These materials are typically prepared from mixtures of methacrylate monomers having different alkyl groups, which may be either straight chain or branched chain groups, and may contain 1 to 18 carbon atoms or mixtures thereof. $C_1$-$C_7$ alkyl groups may be used in admixture with $C_8$-$C_{18}$ or higher alkyl groups.

When a small amount of a nitrogen-containing monomer is copolymerized with alkyl methacrylates, dispersancy properties are incorporated into the product. Thus, such a product has the multiple function of viscosity modification, pour point depressancy and dispersancy and are sometimes referred to as dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. Dispersant viscosity modifiers may also be interpolymers of ethylene and propylene which are grafted with an active monomer such as maleic anhydride and then derivatized with an alcohol or an amine or grafted with nitrogen compounds.

Antioxidants may also be present. Antioxidants encompass phenolic antioxidants, which may be of the general the formula

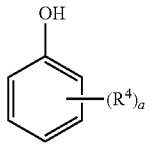

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups, such as

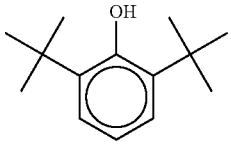

The para position may also be occupied by a hydrocarbyl group or a group bridging two aromatic rings. In certain embodiments the para position is occupied by an ester-containing group, such as, for example, an antioxidant of the formula

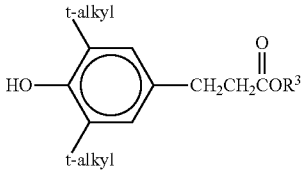

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines, such as those of the formula

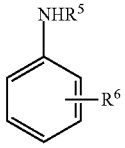

wherein $R^5$ can be an aromatic group such as a phenyl group, a naphthyl group, or a phenyl group substituted by $R^7$, and $R^6$ and $R^7$ can be independently a hydrogen or an alkyl group containing 1 to 24 or 4 to 20 or 6 to 12 carbon atoms. In one embodiment, an aromatic amine antioxidant can comprise an alkylated diphenylamine such as nonylated diphenylamine of the formula

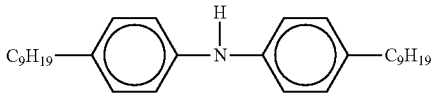

or a mixture of a di-nonylated amine and a mono-nonylated amine. In one embodiment, an aromatic amine antioxidant is present, e.g., in an amount of at least 0.5% by weight of the lubricant. In other embodiments, the amount of aromatic amine antioxidant is at least 1% or 2% and may be, for instance, up to 10, 8, 5, or 3%. In a further embodiment, the lubricant of the present invention does not contain a hindered phenolic antioxidant as the only antioxidant; and in a further embodiment there is an amine antioxidant present and a substantial absence of a hindered phenol antioxidant (e.g., less than 0.5 percent by weight or less than 0.3%, 0.1%, 0.05%, or 0.01%.) In certain embodiments the amount of hindered phenol antioxidant may be less than 2% or less than 1% by weight. In certain embodiments the amount of aminic antioxidant is equal to or greater than the amount of hindered phenolic antioxidant. In certain embodiments (such as, for instance, when the rust inhibitor is a polyether or a polyalkylene oxide, the amount of aminic antioxidant may be greater than 0.5% and the amount of phenolic antioxidant may be less than 1% and/or the amount of aminic antioxidant may be greater than the amount of phenolic antioxidant. The various numerical limits and relative amounts of antioxidants may be combined one with another.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Other conventional components may also be present, including pour point depressants, friction modifiers such as fatty esters, metal deactivators, high pressure additives, antiwear additives, and antifoam agents. Any of these materials can be present or can be eliminated, if desired.

Antioxidants (or oxidation inhibitors) include hindered phenolic antioxidants such as 2,6-di-t-butylphenol and 2,6-di-t-butylphenol with various substituents at the 4 position, including those derived from acrylate ester, secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides. An extensive list of antioxidants is found in U.S. Pat. No. 6,251,840.

The role of the corrosion inhibitor (which material may be but is not necessarily the same as the rust inhibitor) is to preferentially adsorb onto metal surfaces to provide protective film, or to neutralize corrosive acids. Examples of these include, but are not limited to ethoxylates, alkenyl succinic half ester acids, zinc dithiophosphates, metal phenolates, basic metal sulfonates, fatty acids, amines triazoles, and dimercaptothiadiazole derivatives.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Pour point depressants are used to improve the low temperature properties of oil-based compositions. See, for example, page 8 of "Lubricant Additives" by C.V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. Pat. No. 3,250,715.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two or no more than one non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Examples

A. Evaluation of Rust Inhibitors. A selection of rust inhibitors are added in an amount of 0.2% by weight to a conventional lubricant formulation. The base oil employed is a mixture of polyalpha olefins (4 and 6 $mm^2/s$ (cSt)). The base lubricant also contains a viscosity modifier, a mixture of calcium and magnesium detergents, a succinimide dispersant, a sulfurized olefin, 0.5 percent aminic antioxidant, 0.3 percent phenolic antioxidant, a zinc dialkyldithiophosphate, a fatty amide friction modifier, a pour point depressant, and a foam inhibitor. A certain amount of mineral oil is also present, supplied as diluent oil with some of the additive components. The resulting formulations are tested according to ASTM D655A and B rust tests for lubricant oils. Results are reported in terms of % rust on the sample, reported for duplicate runs.

| Rust Inhibitor | distilled water | synthetic sea water |
|---|---|---|
| none | 0, 0 | 4.5-5, 4.5-5 |
| aminopropanol | 0, 0 | 0, 0 |
| oleylamine | 0, 0 | 0.5-1, 0.5-1 |
| polyalkylene oxide (ethylene oxide, propylene oxide) | 0, 0 | 0, 0 |
| ester from hydrocarbyl succinic acid + propylene oxide | 0, 0 | 1, 1 |
| Alkyl-capped polypropylene oxide with a single terminal —OH group, molecular weight 2000 | 0, 0 | 0, 0 |
| Condensation product of polyisobutene-substituted maleic anhydride with 1-(3-aminopropyl)imidazole (32% oil) | 0, 0 | 1, 2 |

B. Effect of Iron on Decomposition. The same lubricant base formulation is prepared, containing varying amounts of added iron, added as soluble iron naphthenate. The lubricants are subject to a bench oxidation test in which a 90 g sample of the oil is place into a long test tube equipped with water condenser. The tube is immersed in a 170° C. oil bath and air is delivered through a glass tube to the bottom of the sample at the rate of 10 L/hour. Samples of the fluid (10 mL) are removed at the time intervals noted and analyzed for kinematic viscosity at 40° C. The results are shown in the following Table:

Viscosity (KV40) as a function of time and Fe concentration

| Time, hr | 37 ppm | 70 ppm | 102 ppm | 133 ppm | 168 ppm | 210 ppm |
|---|---|---|---|---|---|---|
| 0 | 67.8 | 67.8 | 67.7 | 68.6 | 67.3 | 67.3 |
| 72 | 53.0 | 51.1 | 50.1 | 49.8 | 48.4 | 47.5 |
| 96 | 51.0 | 48.6 | 47.1 | 47.4 | 46.4 | 50.5 |
| 120 | 48.6 | 46.7 | 47.4 | 53.4 | 47.8 | 51.9 |
| 144 | 47.3 | 48.5 | 53.9 | 58.9 | 83.1 | 106.0 |
| 168 | 47.3 | 56.6 | 81.1 | 120.0 | 150.0 | 200.0 |

The results show that the presence of increasing concentrations of iron in the lubricant leads to increase in viscosity, indicative of oxidative instability and a tendency to form sludge-like deposits.

The same lubricant formulation, and a second batch of the same lubricant to which is added 0.15% of the alkyl capped polypropylene oxide (2000 m.w.) rust inhibitor mentioned above, are used to lubricate a 1.8 L turbo-charged engine. The engine is fueled with a gasoline which is not particularly "dirty" with respect to sludge formation. After running for 168 hours with each of the lubricant samples, the engine is disassembled and inspected. The rocker cover and piston grooves are assigned merit ratings for sludge and deposits on a scale of 0-10, with a rating of 10 indicating no sludge or deposits.

| | Base lubricant | with rust inhibitor |
|---|---|---|
| Rocker cover | 9.30 | 9.46 |
| Piston groove 1 | 0[a] | 0[a] |
| Piston groove 2 | 5.54 | 7.44 |
| Piston groove 3 | 2.86 | 4.19 |

[a]a rating of 0 for groove 1 indicates a fouled ring, which is an expected result for this test Ratings at each of these locations indicate a significant reduction in the amount of sludge and deposits. The improvement from 9.30 to 9.46 for the rocker cover represents a real and observable reduction in the amount of sludge and deposits, and the improvements in the piston grooves are quantitatively even more significant.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a spark-ignited, turbo-charged, sump-lubricated internal combustion engine with a lubricant wherein the lubricant encounters a temperature within the turbocharger of at least 300° C., wherein said lubricant is contaminated with liquid fuel, and wherein the lubricant is subject to deterioration as revealed by the formation of granular sediment, said method comprising providing said engine with a lubricant which contains an amount effective to reduce the formation of said granular sediment of a rust inhibitor; wherein the engine is fueled with a gasoline which comprises greater than about 5 percent by weight of aromatic materials having one or more hydrocarbyl substituents totaling 3 or more carbon atoms.

2. The method of claim 1 wherein said gasoline has a sulfur content of less than or equal to about 50 parts per million by weight.

3. The method of claim 1 wherein the rust inhibitor is an organic compound having one or more of an amine group, an ether group, a hydroxyl group, a carboxylic acid, ester, or salt group, or a nitrogen-containing heterocyclic group and having a normal boiling point of at least about 150° C.

4. The method of claim 1 wherein the rust inhibitor is selected from the group consisting of polyethers and esters of hydroxy-acids.

5. The method of claim 1 wherein the rust inhibitor comprises a hydroxy-containing polyether.

6. The method of claim 1 wherein the amount of the rust inhibitor is about 0.02 to about 2 percent by weight of the lubricant.

7. The method of claim 1 wherein the lubricant further comprises an aminic antioxidant or an oil soluble alkali metal salt.

8. A method for lubricating a spark-ignited, turbo-charged, sump-lubricated internal combustion engine with a lubricant wherein the lubricant encounters a temperature within the turbocharger of at least 300° C., wherein said lubricant is contaminated with liquid fuel, and wherein the lubricant is subject to deterioration as revealed by the formation of granular sediment, said method comprising providing said engine with a lubricant which contains an amount effective to reduce the formation of said granular sediment of a rust inhibitor, wherein the engine is a spark-ignited engine; wherein the engine is fueled with a gasoline which comprises greater than about 5 percent by weight of aromatic materials having one or more hydrocarbyl substituents totaling 3 or more carbon atoms.

* * * * *